US005375847A

United States Patent [19]

Fromm et al.

[11] Patent Number: 5,375,847

[45] Date of Patent: Dec. 27, 1994

[54] TOY ASSEMBLY

[75] Inventors: Wayne G. Fromm, Toronto, Canada; Lee D. Weinstein, Somerville, Mass.; Steven E. Merry, Wilmington, Mass.; Peter M. Nielsen, Quincy, Mass.

[73] Assignee: The Fromm Group Inc., Toronto, Canada

[21] Appl. No.: 130,681

[22] Filed: Oct. 1, 1993

[51] Int. Cl.[5] ..... A63F 9/02

[52] U.S. Cl. ..... 273/310; 273/311; 273/312; 446/175

[58] Field of Search ..... 273/310–316; 434/21, 23; 446/175, 330

[56] References Cited

U.S. PATENT DOCUMENTS

| | | | |
|---|---|---|---|
| 2,148,612 | 2/1939 | French | 273/310 |
| 2,562,648 | 7/1951 | Sparrow | 273/311 |
| 3,898,747 | 8/1975 | Marshall . | |
| 4,090,714 | 5/1978 | Izushi | 273/310 |
| 4,335,880 | 6/1982 | Meyer et al. | 273/310 |
| 4,586,715 | 5/1986 | Scolari et al. . | |
| 4,772,028 | 9/1988 | Rockhold et al. | 273/311 |
| 4,799,687 | 1/1989 | Davis et al. | 273/312 |
| 4,810,224 | 5/1989 | De Vincent | 446/230 |
| 4,828,525 | 5/1989 | Okano . | |
| 4,844,474 | 7/1989 | Schaub et al. . | |
| 4,865,575 | 9/1989 | Rosenthal . | |
| 4,874,343 | 10/1989 | Rosenthal . | |
| 4,934,937 | 6/1990 | Judd | 434/21 |
| 5,013,276 | 5/1991 | Garfinkel . | |
| 5,119,576 | 6/1992 | Erning . | |
| 5,127,658 | 7/1992 | Openiano | 273/311 |
| 5,158,492 | 10/1992 | Rudell et al. . | |
| 5,169,156 | 12/1992 | Smollar | 273/312 |

*Primary Examiner*—Vincent Millin
*Assistant Examiner*—Kerry Owens
*Attorney, Agent, or Firm*—John C. Thompson

[57] ABSTRACT

A toy assembly 10 including a ray gun 12 capable of projecting a focused beam of light 25, and an electromechanically actuatable target figurine 14 including a body 46, a support 48 for supporting the body of the figurine in an upright position upon a surface, a light receiver 58, a toppling mechanism 60 for causing the figurine to topple over when operated, an energy source 82 within the figurine for powering the toppling mechanism, and a control circuit 78 for initiating the operation of the toppling mechanism when the light receiver is struck by a beam of light projected by the ray gun.

20 Claims, 10 Drawing Sheets

TOY ASSEMBLY

TECHNICAL FIELD

The present invention relates generally to children's toys, and more particularly to a toy assembly which includes a gun or the like for projecting a beam of light, and an electromechanically actuated target figurine which is provided with toppling means for causing the figurine to topple over when a light receiver on the figurine receives a ray of light projected by the toy gun. The figurines may be associated with a structure which will indicate when a figurine has been toppled over.

BACKGROUND OF THE INVENTION

Toy soldiers and guns have been traditional play things for children for many years. The child will frequently pick up the gun and point it at a toy soldier, pull the trigger and say, "Bang, you're dead!" However, even though toy soldiers and guns have been available for many years, there has always been a certain lack of realism to the game except when the gun fires a projectile to knock over the toy soldier. However, since "Star Trek" and "Star Wars," there is a certain preference among children for ray guns. However, the disadvantage of a gun which projects a beam of light is that, until now, it has not been able to knock over the toy soldier.

It is well known in the prior art to utilize a light projecting device to control a race car and representative examples are shown in U.S. Pat. Nos. 4,828,525 and 4,865,575. In addition, it is also known that a light ray projecting device may be utilized to cause the upper limbs, torso, and head of a stationary doll to move, this being shown in U.S. Pat. Nos. 5,013,276 and 5,158,492. However, these toys do not cause the figurine to topple as desired when playing with toy soldiers and guns.

It is also known from U.S. 4,844,474 that a vehicle may be designed which will "explode" when struck by a beam of light. While this design has advantages over the other prior art referred to above when playing war games, there is still nothing in this patent which teaches that a figurine can be caused to be toppled over when struck by a beam of light.

OBJECTS AND SUMMARY OF THE INVENTION

It is a principal object of the present invention to provide a toy assembly including a ray gun capable of projecting a focused beam of light, and an electromechanically actuatable target figurine which will topple when a light receiver on the figurine is struck by a beam of light projected by the ray gun.

More particularly, it is an object of the present invention to provide a toy assembly including a ray gun capable of projecting a focused beam of light, and an electromechanically actuatable target figurine including a body, a support for supporting the body of the figurine in an upright position upon a surface, a light receiver, a toppling mechanism for causing the figurine to topple over when operated, an energy source within the figurine for powering the toppling mechanism, and control means for initiating the operation of the toppling mechanism when the light receiver is struck by a beam of light projected by the ray gun.

It is an additional object of the present invention to also provide a figurine receiving structure having doors, windows, or the like which, when in a first position, may conceal a figurine, and when in a second position, may expose the figurine. The structure will have means to selectively move one or more of the doors or windows from a closed to an open position, will have a scoring device, and switching means operable to cause the scoring device to indicate a hit when one of the exposed figurines is toppled.

The foregoing objects and other objects and advantages of this invention will become more apparent to those having ordinary skill in the art after a consideration of the following detailed description taken in conjunction with the accompanying drawings.

DETAILED DESCRIPTION

In General

Figure 1:
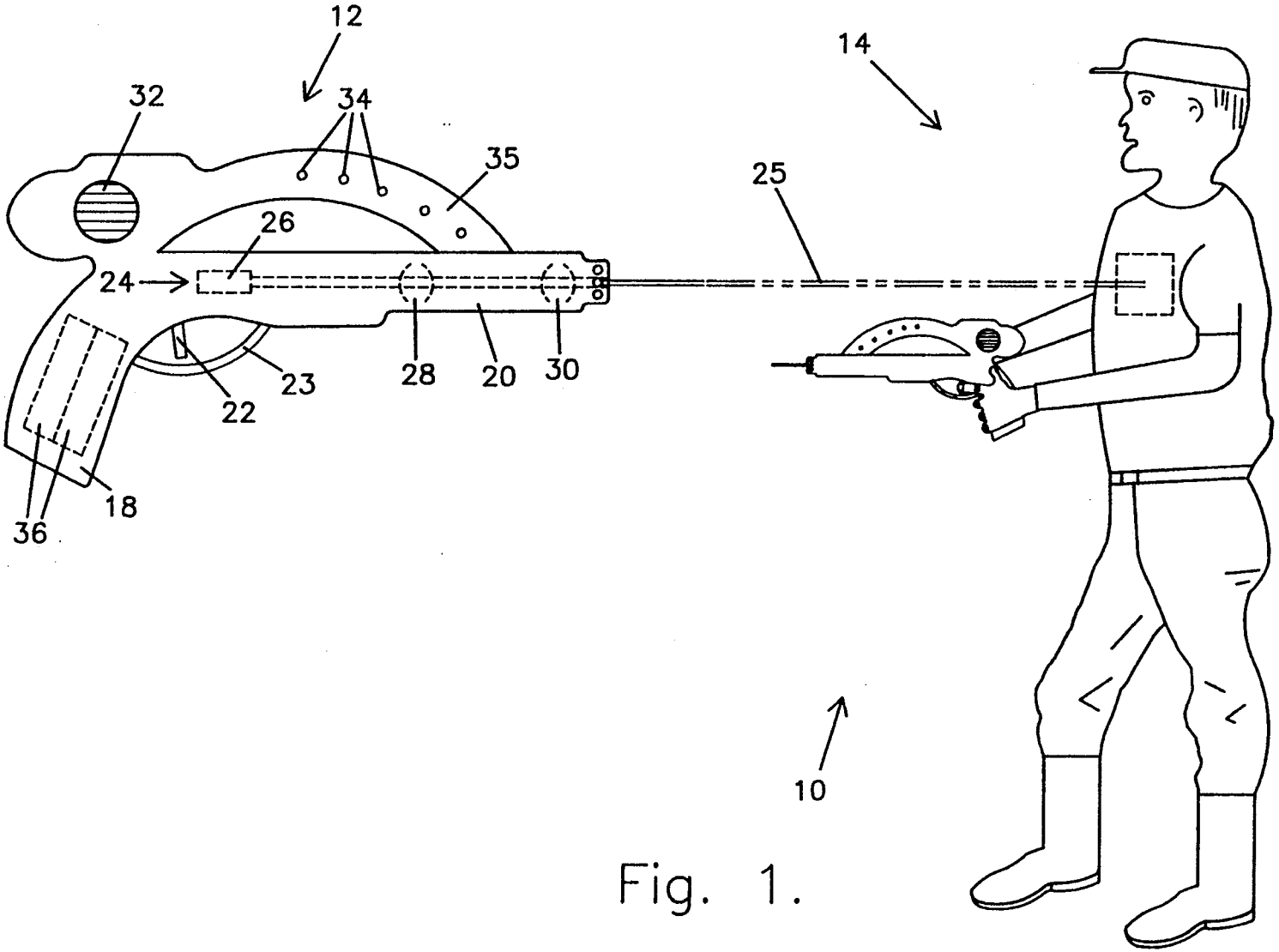
FIG. 1 is a view of the toy assembly of this invention including a ray gun and an electromechanically actuatable target figurine.

With reference first to FIG. 1, the toy assembly of this invention, which is indicated generally at 10, includes a ray gun indicated generally at 12, and an electromechanically actuatable target figurine indicated generally at 14. In addition to the gun 12 and figurine 14 shown in FIG. 1, the toy assembly may also include a figurine receiving structure indicated generally at 16 in FIG. 9. In the following description, common parts in the various embodiments will be designated by the same reference numerals.

The Ray Gun

The ray gun 12, which is best shown if FIG. 1, includes a handle 18, a barrel 20, and a trigger 22 within trigger guard 23. Means 24 for projecting a focused beam of light 25 are mounted within the barrel and include an infrared light emitting diode 26 and focusing lenses 28 and 30, a relatively narrow beam of light being projected by the ray gun when the trigger is pulled. The gun may also enclose a speaker mounted behind a speaker grill 32, lights, in the form of Light Emitting Diodes (LED's) 34, the lights being supported on a light bridge 35. In addition, the handle 18 is provided with a battery pack receiving chamber for receiving a battery pack indicated at 36. The batteries may be of any desired type, such as rechargeable NiCad batteries.

Figure 5:
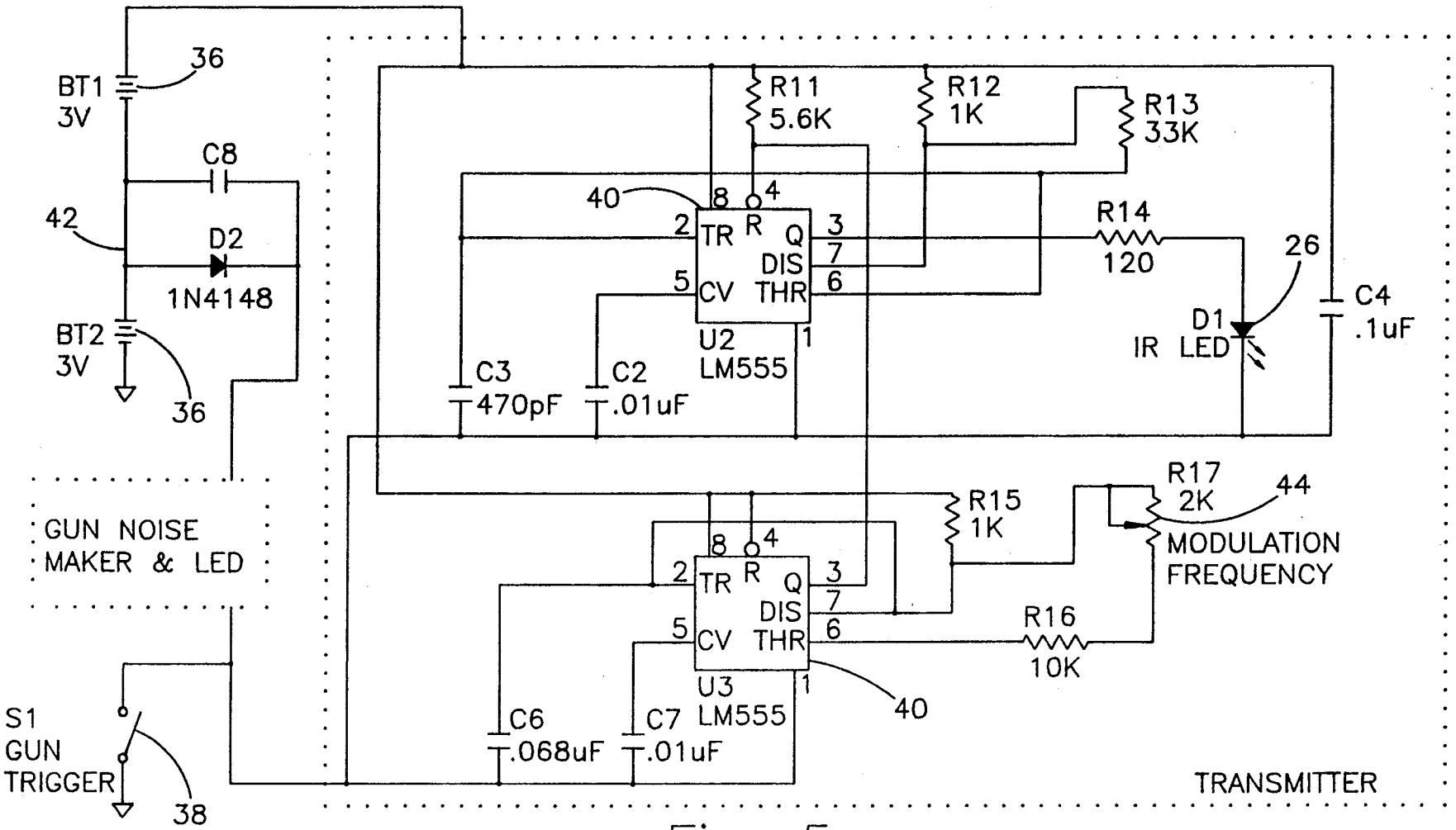
FIG. 5 illustrates an electrical circuit employed in the ray gun shown in FIG. 1.

The ray gun will project an amplitude-modulated infrared beam. The circuit utilized for projecting this beam, and for other purposes, is shown in FIG. 5. The circuit includes, in addition to the infrared light emitting diode 26 and the batteries 36, a gun trigger switch 38, two LM555 integrated circuit timing devices 40, a 1N4148 diode 42, a 2 K variable resistor 44, and various other resistors and capacitors whose values are shown in FIG. 5. In addition, the circuit will also include a gun noise maker in the form of a speaker, which will be mounted behind the speaker grill 32, and the LED's 34. This portion of the circuit is not illustrated as per se it forms not part of the present invention. It should be noted that the purpose of the timers 40 is to limit the length of time the amplitude-modulated infrared beam is projected by the ray gun. The gun is operated simply by pulling the trigger which will close switch 38, causing the beam of light to be projected for a brief period of time while at the same time, or perhaps for a longer duration of time, projecting a suitable sound through the speaker grill 32 and causing the LED's 34 to flash.

Figurine—First Embodiment

Figure 2:
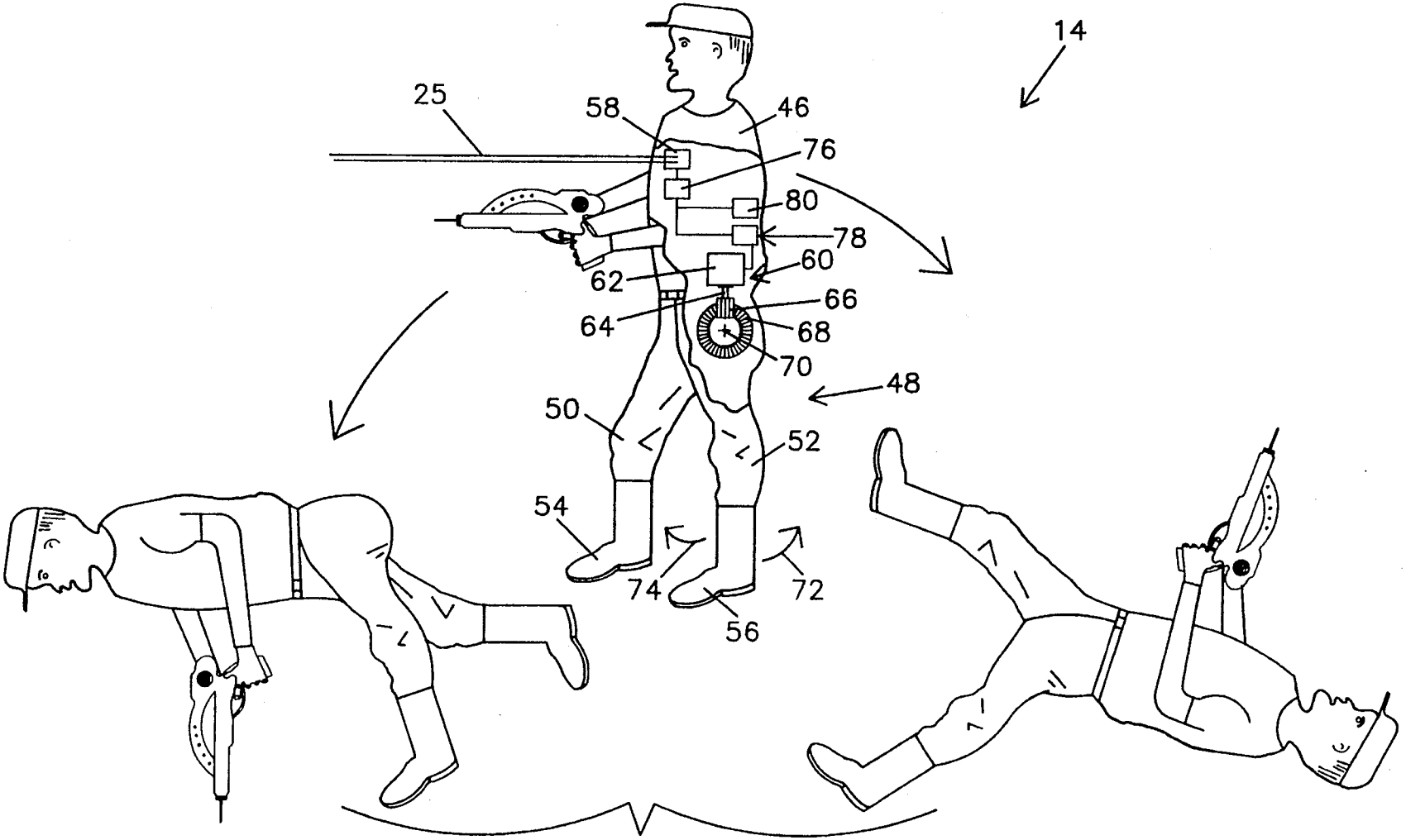
FIG. 2 is a view of a first embodiment of the target figurine shown in FIG. 1 and showing the target figurine in an un-toppled position in the center of the view and in a toppled position to either side of the standing figurine.

With reference now to FIG. 2, a first embodiment of the electromechanically actuatable target figurine 14 is illustrated, the figurine being shown in its normal upright position in the center of FIG. 2, and in a toppled over position either to the right-hand side or to the left-hand side. The figurine includes a body 46 (shown partially in section in the upright position in this figure) and support means indicated generally at 48 for normally supporting the body in an upright position. In the various embodiments shown in this patent application the body is that of a warrior. The support means includes right and left legs 50, 52, respectively, as well as right and left feet 54, 56, respectively. The left leg is mounted for swinging or pivotal movement. To this end the leg 52 can be mounted with a ball and socket type connection which is similar to that used in dolls. The actual details of the construction of the mounting of the leg will be obvious to one having ordinary skill in the art. A light receiver 58 is mounted on the body and is coupled to a tone decoder which will initiate a logic signal when the beam of light projected by the ray gun is received thereon. Toppling means, indicated generally at 60, are disposed within the body. In the embodiment shown in FIG. 2 a first form of toppling means in the form of force applying means which exerts a force against the surface upon which the figurine is provided, the force applying means causing the figurine to topple over when operated. This toppling means 60 includes a drive means to move the left leg either forwardly or rearwardly. To this end, the drive means includes a motor 62 having an output shaft 64 upon which is mounted a pinion gear 66. The pinion gear engages a driven gear 68 in the form of a circular rack, the driven gear being mounted about the pivot point 70 of the left leg 52. If the motor is caused to be rotated in a direction to move the leg rearwardly in the direction of arrow 72, the figurine will fall backwardly to the position illustrated to the right of FIG. 2. Similarly, if the motor moves the leg 52 forwardly in the direction of arrow 74, the figurine will fall forwardly to the position shown to the left in FIG. 2.

Figure 6:
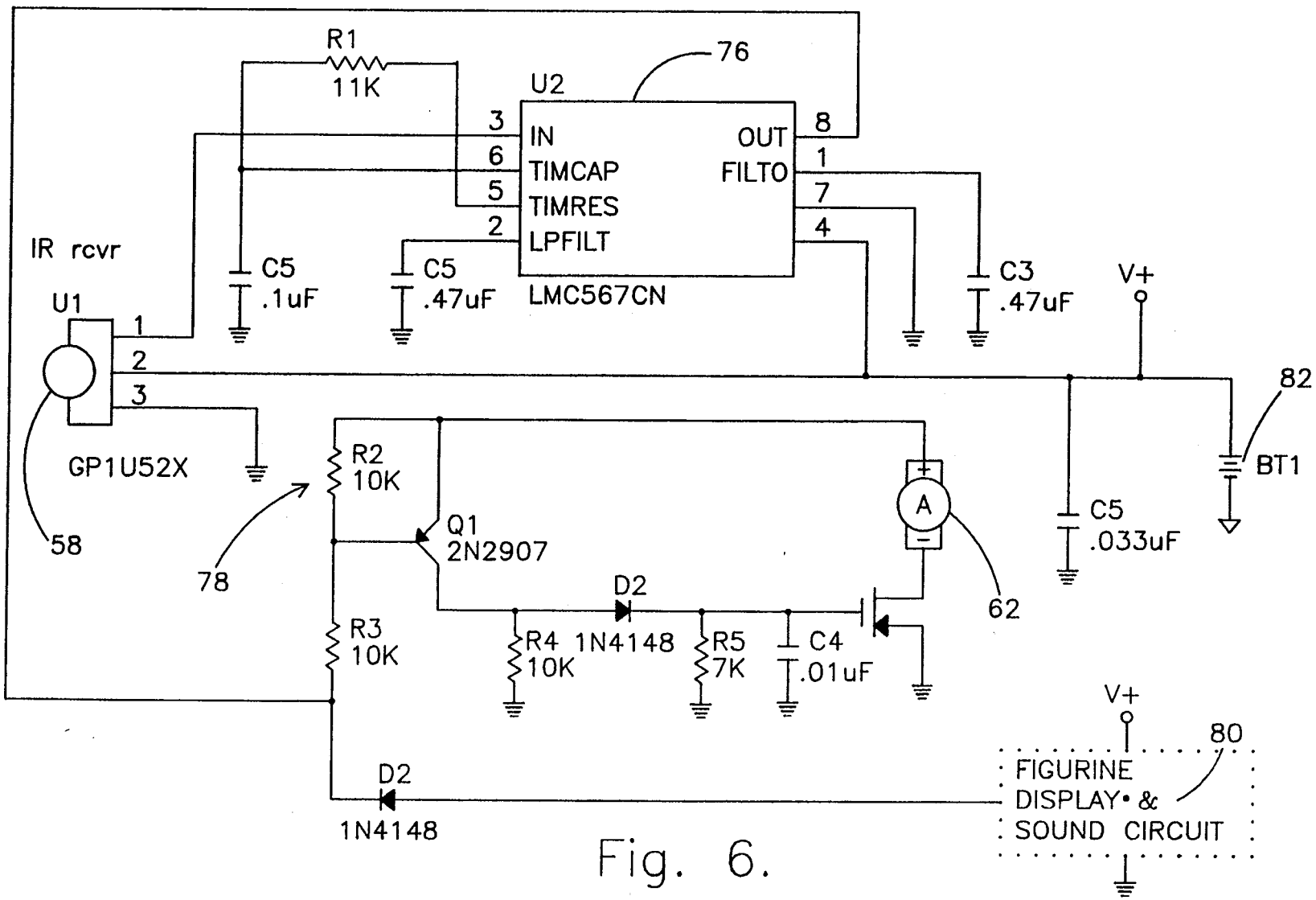
FIG. 6 illustrates the electrical circuit which may be utilized in the first through third embodiments shown in FIGS. 2–4.

The electrical circuit for controlling the toppling means is best shown in FIG. 6 and includes, in addition to the infrared receiver 58 and motor 62, an integrated circuit (LNC567CN) which acts as a tone decoder indicated by reference numeral 76. A logic signal from the tone decoder is transmitted to the electrical driver circuit or control means, which is indicated generally at 78, which initiates the operation of the toppling means by transmitting a driving signal to the motor 62 in response to the logic signal. The figurine may be provided with LED's for eyes, or with a sound generator (neither of which are shown), both or which are under the control of the figurine display and sound controller indicated at 80. The circuit also includes an energy source in the form of a battery 82 which may be mounted at any suitable location within the figurine. Other components of the electrical circuit may be seen from FIG. 6.

In the design illustrated in FIGS. 1 and 2, the optical signal is an amplitude-modulated infrared light beam. The infrared receiver 58 in the figurine serves to decode the high frequency amplitude-modulated light beam and to transmit to the tone decoder any remaining low-frequency amplitude modulation information. In the embodiment of the ray gun shown in FIG. 1, the beam first modulated at 40 kilohertz. The 40 kilohertz beam is then modulated at approximately 330 hertz. Any modulation scheme that shows a high degree of rejection of ambient signals could be employed. When a beam is received by the light receiver 58 it will cause the motor to be operated as long as the beam is being projected. Therefore, in order to prevent undue operation of the motor, a timer (not shown) in the gun will cause the light beam to be projected only for a length of time sufficient to cause the figurine to topple.

Figurine—Second Embodiment

Figure 3:
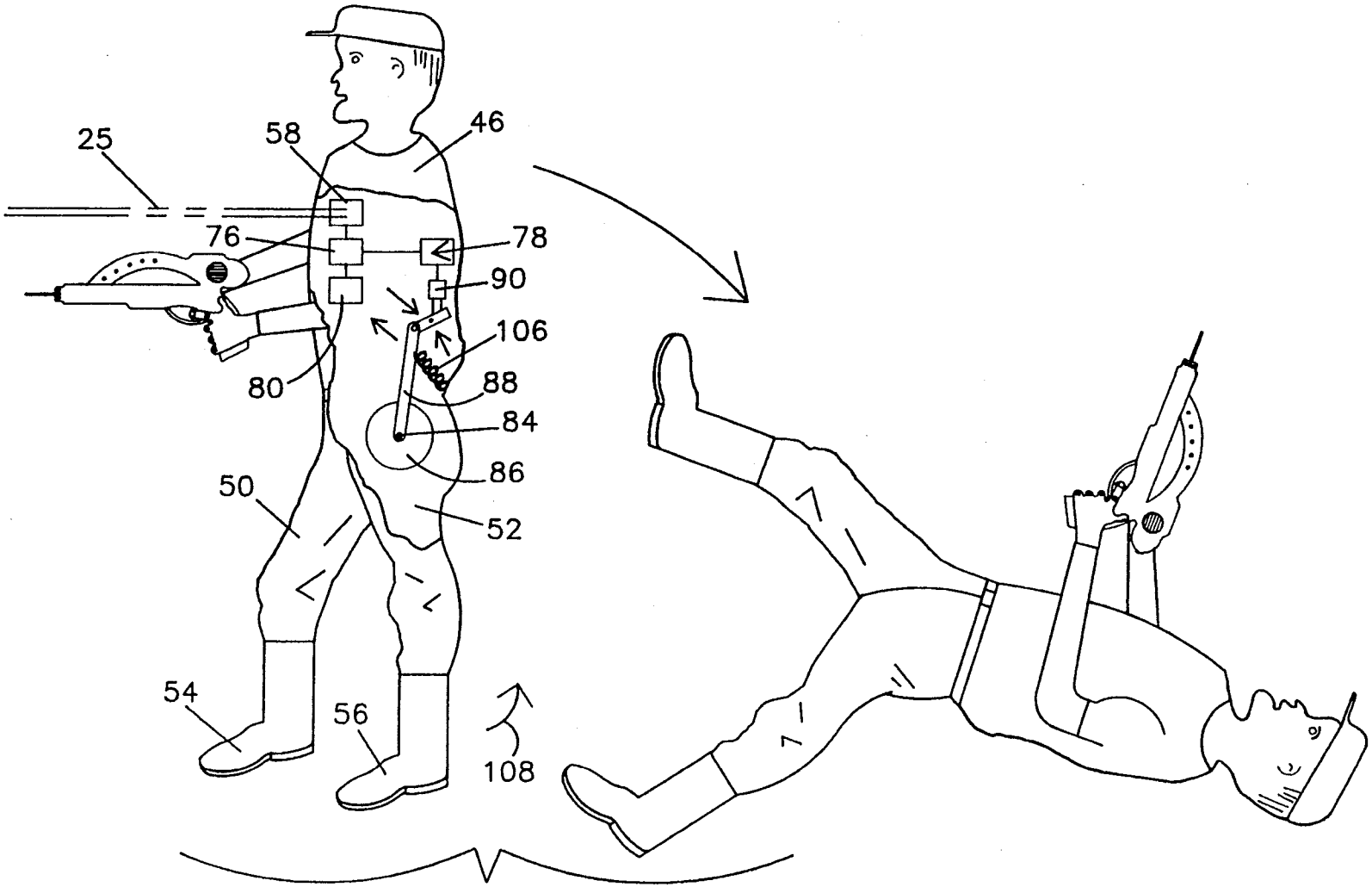
FIG. 3 illustrates a second embodiment of the target figurine shown in FIG. 1, the target figurine being shown in a toppled over position to the right in this figure.
Figure 3A:
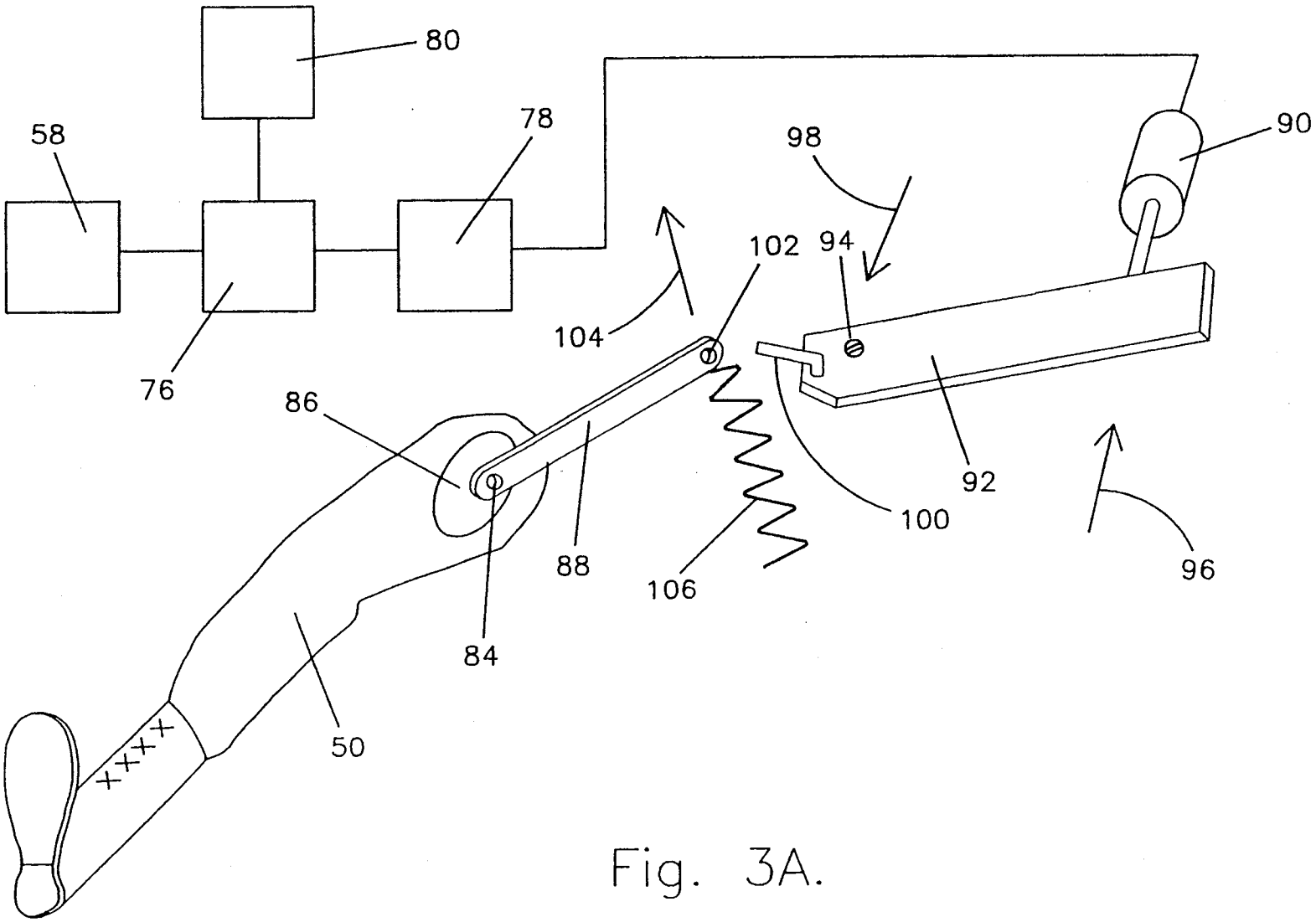
FIG. 3A is a detail of the mechanism for causing the figurine shown in FIG. 3 to topple over.

Now with reference to FIGS. 3 and 3A, a second embodiment of the figurine is illustrated. This embodiment corresponds to the embodiment shown in FIG. 2 in that drive means are provided to move a leg either forwardly or rearwardly. In the illustrated embodiment one of the legs (the left leg in FIG. 3 and the right leg in FIG. 3A) is pivotally secured to the body 46 so that it pivots about pivot 84. A disk 86 may be secured to the movable leg, and a lever 88 may be secured to the disk. The mechanism for moving the lever 88 is best illustrated in FIG. 3A. This mechanism includes a solenoid 90 which is under the control of the control means 78. The solenoid 90 is connected to a link 92 pivoted about pivot pin 94. When the solenoid is actuated it will move the right hand end of the link 92 in the direction indicated by the arrow 96. This will cause the other end of the link 92 to move in the opposite direction as indicated by the arrow 98. When this happens a pin 100 will be released from an aperture 102 in the lever 88 permitting it to be moved in the direction of the arrow 104 due to the action of a compression spring 106, To reset the structure shown in FIG. 3, it is only necessary to move the leg in a direction opposite to the arrow 108 at which time the pin 100 will again engage the aperture 102 in the lever 88, the spring 106 being suitably compressed. When the latch mechanism 100, 102 is released due to the action of the solenoid, there will be a rapid movement due to the compressed spring being released, and direction as indicated by the arrow 98. When this happens a pin 100 will be released from an aperture 102 in the lever 88 permitting it to be moved in the direction of the arrow 104 due to the action of a compression spring 106. To reset the structure shown in FIG. 3, it is only necessary to move the leg in a direction opposite to the arrow 108 at which time the pin 100 will again engage the aperture 102 in the lever 88, the spring 106 being suitably compressed. When the latch mechanism 100, 102 is released due to the action of the solenoid, there will be a rapid movement due to the compressed spring being released, and the toppling action of the figurine will start more rapidly than that of the figuring shown in FIG. 2. The control circuits for this embodiment are substantially identical to that shown in FIG. 6 except that a solenoid is operated by the control means 78 rather than a motor.

Figurine—Third Embodiment

Figure 4:
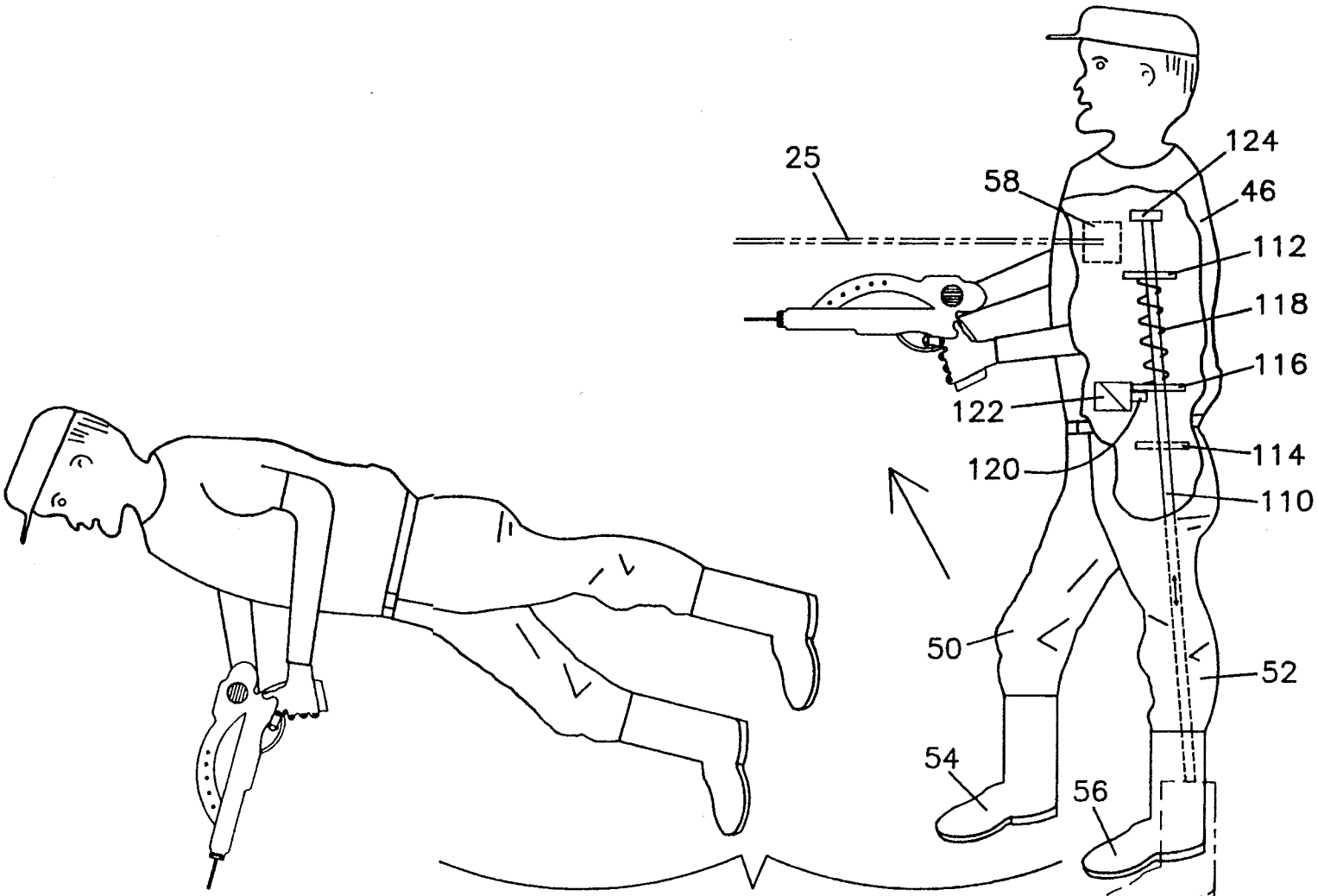
FIG. 4 is a view of a third embodiment of the target figurine shown in FIG. 1.

The third embodiment which is shown in FIG. 4 also operates by applying a force against the surface upon which the figurine stands to cause it to topple over. In this case the legs do not move, but one of the feet, specifically the left foot 56, is rapidly moved downwardly when the control means causes a latch to be released. In this design the same circuit shown in FIG. 6 as modified for FIG. 3, is also utilized. The foot 56 is mounted on an extensible and retractable vertical structure in the form of a shiftable rod 110 which is suitably guided within apertures within mount plates 112, 114 fixedly carried by the figurine. The rod carries a disk 116. A compression spring 118 extends between the upper mounting plate 112 and the disk 116. The disk 116 is held in its retracted position by a latch 120 which is normally spring biased to figurine to topple over as its center of gravity is shifted outside of the other foot 54. The movement of the rod 110 in a downward direction is limited by a stop 124 carried by the upper end of the rod, which stop can contact the upper surface of the mounting plate 112. To reset this embodiment it is only necessary to push the foot 56 back to its full line position, to cause the disk 116 to be latched again.

Figurine—Fourth Embodiment

Figure 7:
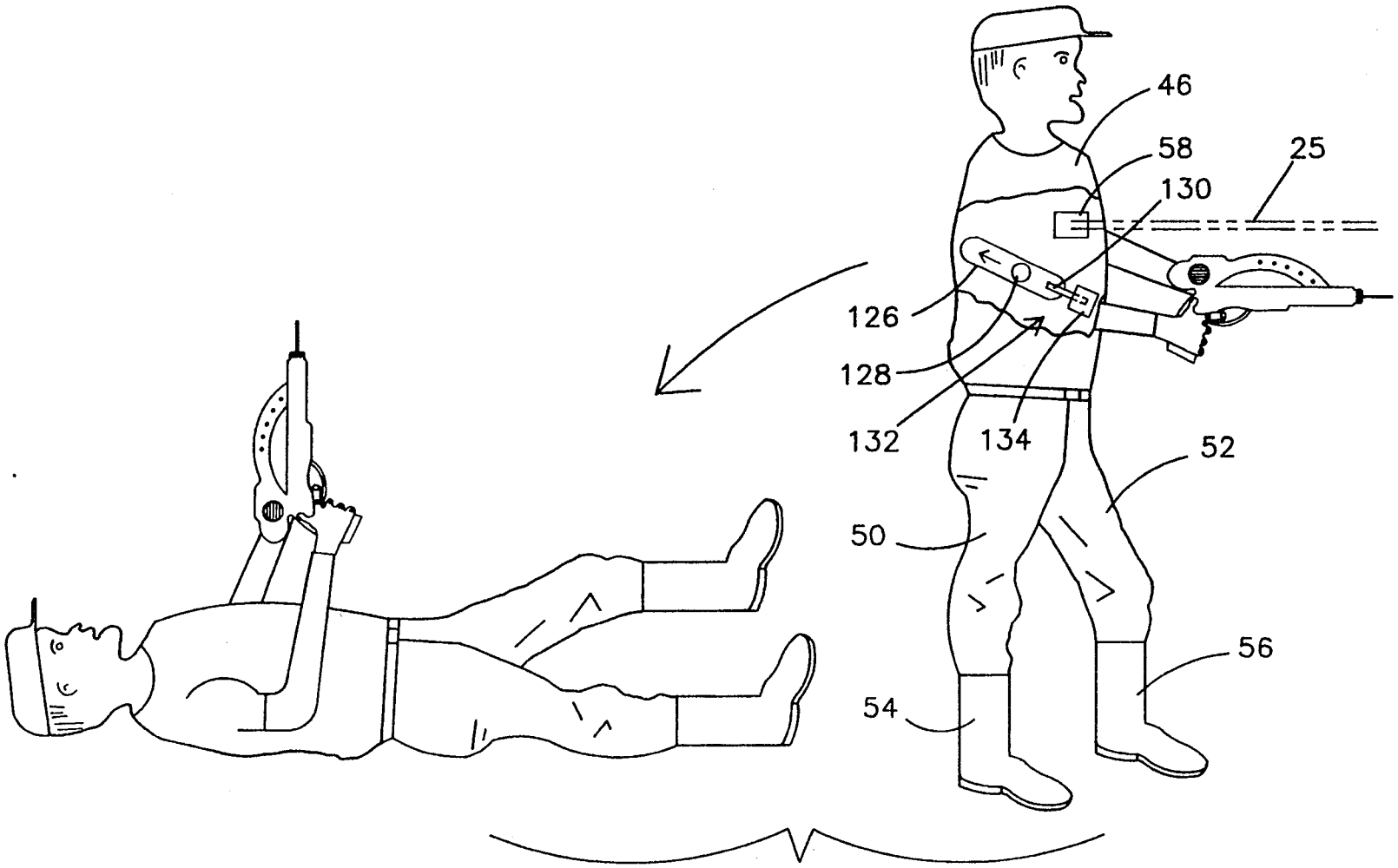
FIG. 7 illustrates a fourth embodiment wherein a solenoid acts against a weight to shift the center of gravity of the figurine to cause it to topple over.
Figure 8:
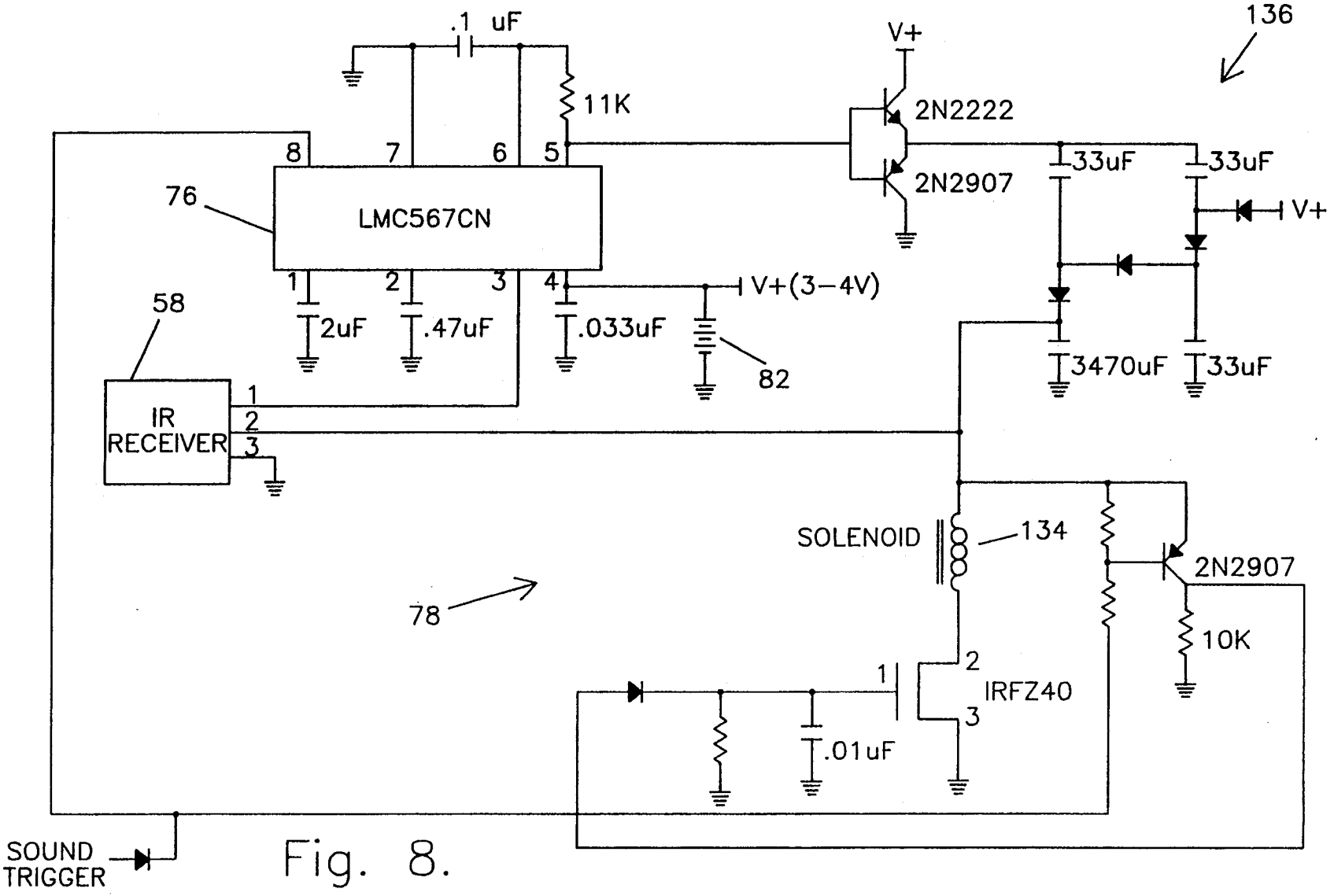
FIG. 8 illustrates a circuit which may be used with the FIG. 7 embodiment.

In the first, second and third embodiments, the figurine was caused to topple over by a force applying means which exerted a force against the surface upon which the figurine was standing. In the embodiment shown in FIG. 7 only a weight is shifted to change the center of gravity of the figurine to an unbalanced position. In this embodiment the body 46 is provided with an inclined track 126. A weight 128, which may be a spherical ball, is mounted for movement on the track. Due to gravity, the weight 128 will normally be disposed at one end of the track in contact with a pin 130. Moving means, indicated generally at 132, are provided for moving the weight upwardly along the track. The moving means includes the pin 130 which is connected to a solenoid 134. When the solenoid is operated it will project the pin in the direction of the weight 128. A circuit similar to that shown in FIG. 6 may be utilized in the figurine of FIG. 7. However if a low output battery is employed an alternate circuit may be used to charge a capacitor for actuation of the solenoid. Such a circuit is shown in FIG. 8, This circuit is similar to that shown in FIE. 6 in that it employs a battery 82 to power the circuit, a light receiver 58, a tone detector 76, and a control circuit 78 for initiating the operation of the solenoid 134. However, in order to permit the use of a low output battery a voltage triplet circuit, indicated generally at 136 is employed. A voltage triplet circuit requires an oscillator to drive it. In the embodiment illustrated, the voltage tripler circuit is connected to an oscillator within the tone detector 76 through integrated circuit pin 5. In this way it is net necessary to provide a separate oscillator for the voltage triplet circuit.

Figurine Receiving Structure

Figure 9:
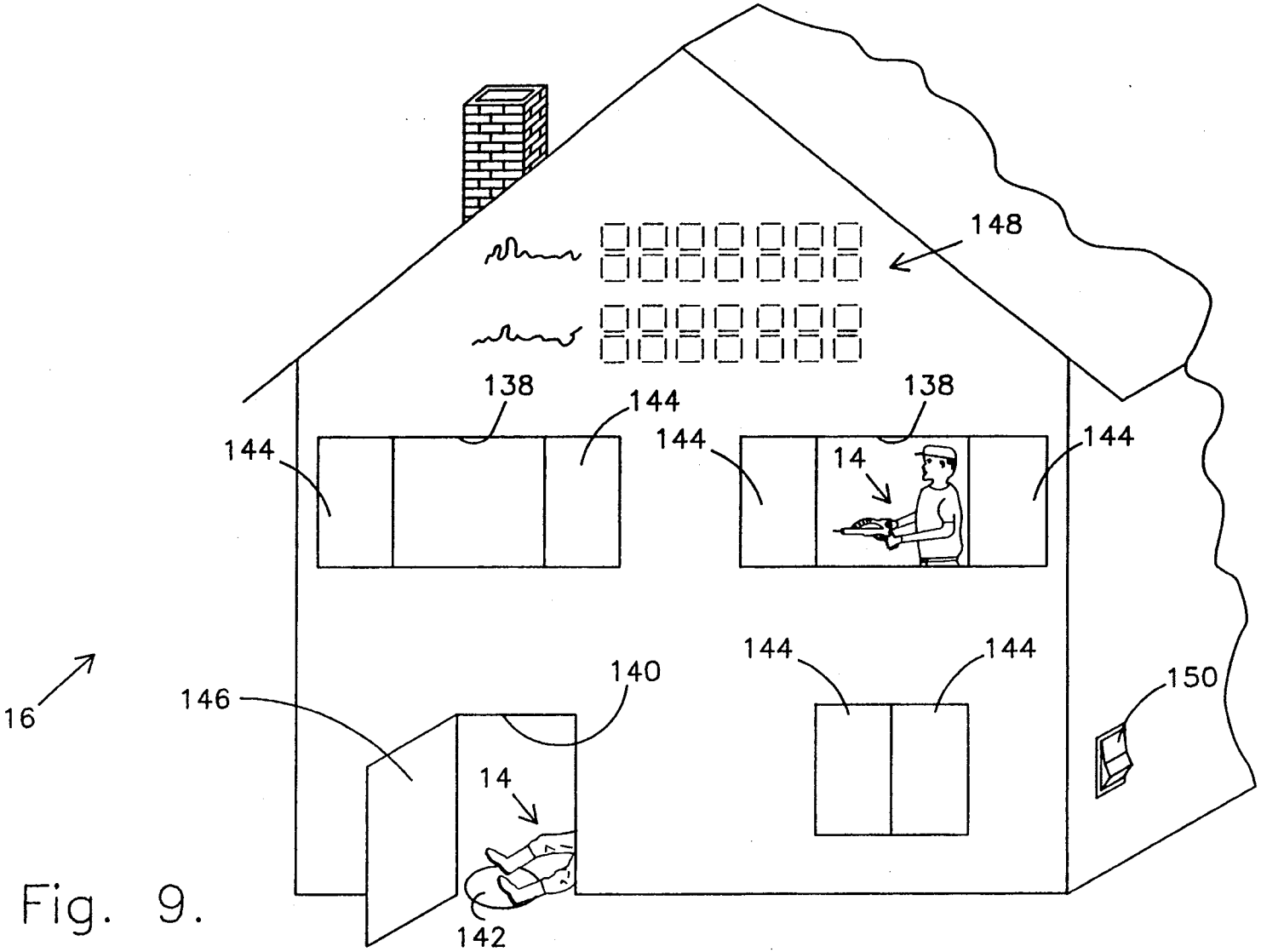
FIG. 9 illustrates a figurine receiving structure.

As previously indicated, the figurines may be placed within a structure designed for receiving them. Such a structure, which has the form of a house, is shown in FIG. 9. The house is provided with openings 138 which resemble windows, and further openings 140, which resemble Behind each of the openings there will be a sensor 142. The openings 138, 140 will be closed by movable coverings after the figurines have been placed upon the sensors 142, which coverings may resemble shutters 144 and doors 146. The coverings 144, 146 are caused to be opened in a random sequence by any suitable mechanism. When the figurines 14 are shot by the ray gun 12 they will fall over. As the weight of the figurine will no longer on the sensor 142, an indicia in the form of a scoreboard 148 will shown the number of hits. Two fields of indicia may be provided for two players, and a toggle switch 150 can be utilized to turn on one field of indicia or the other.

While preferred forms of this invention have been described above and shown in the accompanying drawings, should be understood that the applicant does not intend to be limited to the particular details described above and illustrated in the accompanying drawings. For example, a light emitting grenade may be employed rarer than a ray gun. Therefore, applicant intends to be limited only to the scope of the invention as defined by the following claims.

What is claimed is:

1. A toy assembly comprising:

a light source for providing an optical information signal; and an electromechanically actuatable target figurine which may be placed at various locations upon any generally horizontal planar surface, the figurine including a body, support means in the form of legs for normally supporting the body of the figurine in an upright standing up position at any selected location upon the generally horizontal planar surface, a light receiver for detecting said optical information signal and for rejecting unlike signals, toppling means for causing the body and support means to topple over to a fallen down position on the generally horizontal planar surface, an energy source within the figurine for powering the toppling means, and control means for initiating the operation of the toppling means when the light receiver detects said optical information signal.

2. The toy assembly as set forth in claim 1 wherein the toppling means includes weight shifting means for changing the center of mass of the figurine from a balanced position to an unbalanced position so that the figurine is no longer balanced upon the support means and will topple over.

3. The toy assembly as set forth in claim 2 wherein the weight shifting means includes an inclined track, a weight movable along the track, the weight being at a normal at rest position at the low end of the track due to gravity, the center of mass being in a balanced position over the support means when the weight is in its normal at rest position, and moving means for moving the weight upwardly along the track to an unbalanced position where the center of gravity is no longer balanced over the support means whereby the figurine will topple over.

4. The toy assembly as set forth in claim 3 wherein the moving means is a solenoid operated pin which, when actuated, will strike the weight to move it along the track away from its normal at rest position.

5. The toy assembly as set forth in claim 3 wherein the weight is spherical and will roll along the track when moved by the moving means.

6. The toy assembly as set forth in claim 1 wherein the toppling means is a force applying means which causes a force to be exerted against the surface upon which the figurine is standing to cause the figurine to topple over.

7. The toy assembly as set forth in claim 6 wherein the force applying means is an extensible and retractable vertically shiftable structure which will cause the figurine to topple over when extended, and which may be retracted to permit the figurine to stand upright.

8. The toy assembly as set forth in claim 7 wherein the extensible and retractable structure is connected to one of the legs to cause it to shift vertically.

9. The toy assembly as set forth in claim 8 wherein the vertically shiftable structure includes a vertically shiftable rod extending upwardly from the vertically shiftable leg, a spring, and a latch, the rod being spring biased to an extended position, wherein the rod is latched in a retracted position, and wherein when the latch is released the rod is spring biased to the extended position to cause the figurine to topple.

10. The toy assembly as set forth in claim 9 further including a solenoid, the latch being released by the solenoid, the solenoid being energized by the energy source when the light receiver detects said optical information signal.

11. The toy assembly as set forth in claim 6 wherein is mounted on the body for movement, and wherein the toppling means includes drive means to move said one leg.

12. The toy assembly as set forth in claim 11 wherein said leg is pivotally secured to the body of the figurine, and wherein the drive means includes a motor having an output shaft, a pinion gear carried by the output shaft, and a driven gear connected to the leg which is pivotally secured to the body, said driven gear when driven by the pinion gear causing the leg to move about said pivot causing the figurine to topple over.

13. The toy assembly as set forth in claim 11 wherein said leg is pivotally secured to the body, and wherein the drive means includes a lever carried by the pivotal leg, a latch, the lever normally being latched in a first position, the legs supporting the figurine in an upright position when the lever is in its latched first position, biasing means for biasing the lever to a second position, and release means for releasing the latch when the light receiver initiates operation, the pivotal leg when being biased to the second position after the latch has been released causing the figurine to topple over.

14. The toy assembly as set forth in claim 13 wherein the release means includes a solenoid for disengaging the latch.

15. The toy assembly as set forth in claim 1 wherein the light source is a ray gun which projects an amplitude-modulated infrared beam.

16. The toy assembly as set forth in claim 15 wherein the light receiver receives the amplitude-modulated infrared beam and initiates a logic signal, and wherein the control means transmits a driving signal to the toppling means in response to the logic signal.

17. The toy assembly as set forth in claim 1 wherein the figurine includes a tone decoder and a voltage triplet, the voltage triplet being coupled to the oscillator of the tone decoder.

18. The toy assembly as set forth in claim 15 wherein the figurine is further provided with a sound emitting device, wherein the light receiver receives an amplitude-modulated infrared signal and initiates a logic signal, and wherein the control means transmits a control signal to the sound emitting device to cause it to emit a sound when the light receiver receives the optical information signal.

19. The toy assembly as set forth in claim 1 wherein the assembly further includes a figurine receiving structure having one or more movable coverings which when in a first position may conceal a figurine and when in a second position may expose a figurine, and covering operating means to selectively move one or more of the coverings between their first and second positions.

20. The toy assembly as set forth in claim 19 wherein the figurine receiving structure is further provided with indicia capable of indicating when a figurine has been toppled, and switching means operable to cause the indicia to indicate a hit when the figurine topples.

* * * * *

UNITED STATES PATENT AND TRADEMARK OFFICE

CERTIFICATE OF CORRECTION

PATENT NO. : 5,375,847
DATED : December 27, 1994
INVENTOR(S) : Wayne G. Fromm, et al It is certified that error appears in the above-identified that said Letters Patent is hereby corrected as shown below:

Column 7, line 39, claim 11, should read as follows:

11. The toy assembly as set forth in claim 6, wherein one of the legs is mounted on the body for movement, and wherein the toppling means includes drive means to move said one leg.

Column 8, claim 17, line 27, "triplet" should read --tripler--

Signed and Sealed this

Eleventh Day of July, 1995

*Attest:*

Bruce Lehman

BRUCE LEHMAN

*Attesting Officer*

*Commissioner of Patents and Trademarks*